United States Patent [19]

Mohr et al.

[11] Patent Number: 4,635,557

[45] Date of Patent: Jan. 13, 1987

[54] MACHINE FOR WORKS ON A RAILWAY TRACK WITH CONTINUOUS ADVANCE

[75] Inventors: Pierre Mohr, Ligny-en-Barrois; Gérard Mohr, Forbach, both of France

[73] Assignee: Framafer, Bening-Les-Saint-Avold, France

[21] Appl. No.: 708,662

[22] Filed: Mar. 6, 1985

[30] Foreign Application Priority Data

Mar. 30, 1984 [FR] France ..... 84 05085

[51] Int. Cl.[4] ..... E01B 27/17

[52] U.S. Cl. ..... 104/7.2; 104/12; 105/32

[58] Field of Search ..... 104/2, 7 R, 7 B, 12; 105/31, 32; 254/37, 105, 106

[56] References Cited

U.S. PATENT DOCUMENTS 3,040,677 6/1962 Creedle ..... 105/31
3,687,081 8/1972 Plasser et al. ..... 104/12

FOREIGN PATENT DOCUMENTS 1454380 8/1966 France .
2442749 6/1980 France .
2070670 9/1981 United Kingdom .
2126635 3/1984 United Kingdom .

*Primary Examiner*—Randolph A. Reese
*Attorney, Agent, or Firm*—Weingarten, Schurgin, Gagnebin & Hayes

[57] ABSTRACT

The invention relates to a continuously advancing machine for works on a railway track, comprising a main chassis mounted on bogies and provided with a mobile auxiliary chassis supporting working members such as ballast tamping and track lifting/shifting units. The auxiliary chassis may move along the main chassis under the action of a bar for attachment to a chain driven by a motor and borne by a carriage, so as to advance, during the works, step by step with respect to the track while the machine progresses continuously. The reactions of inertia are entirely taken up by the track, via the carriage immobilized thereon thanks to grippers during the phases of advance of the auxiliary chassis and its working units.

10 Claims, 4 Drawing Figures

MACHINE FOR WORKS ON A RAILWAY TRACK WITH CONTINUOUS ADVANCE

The present invention relates to a continuously advancing machine for works on a railway track, comprising a main chassis provided with members for rolling on the track and an auxiliary chassis supporting working members such as ballast tamping and track lifting/shifting units, the latter chassis being fast with a mobile chassis which may move in translation along the main chassis under the action of drive means so as to advance, during the works, step by step with respect to the track while the machine progresses continuously.

A machine of this type is characterized, in operation, by a continuous advance of the main chassis on which is superposed a discontinuous advance of the auxiliary chassis supporting the working members. This latter must, in fact, particularly in the case of a track tamping machine, start up, brake and stop at each work cycle, over a relatively short path of displacement determined for example by a gap of 50 to 60 cm between the ties of the track.

Railway track tamping machines designed to this end are already known, in which the auxiliary chassis bearing the tamping and lifting/shifting members is composed of a chassis resting at the rear on an axle circulating on the rails between the rolling members of the main chassis of the tamping machine. This chassis is provided in its front part with two drawbars sliding with respect to the main chassis in appropriate guiding devices. The mobile chassis is accelerated and braked at each work cycle by a longitudinal jack, fast at one end with the mobile chassis and at the other end with the main chassis of the tamping machine.

A tamping machine designed according to this principle makes it possible to obtain a substantial increase in the operating performance with respect to tamping machines in which the working members are fixed with respect to the main chassis and therefore require, for their displacement from tie to tie, the acceleration and braking of the whole of the machine.

The continuously advancing tamping machines make it possible, in the phase of displacement of the working members from tie to tie, to be free of the conditions of wheel/rail adherence and, consequently, considerably to reduce the duration of this phase, since the efforts of acceleration or of deceleration of the working members are no longer to be transmitted in the form of driving torques acting on the wheels of the machine circulating on the rails. The systems of translation of the working units, characterizing this type of tamping machine, in fact enable much greater efforts of traction and of braking to be imparted to the working units.

However, a problem peculiar to this type of continuously advancing tamping machine resides in the compromise that must be found between the increase in output theoretically rendered possible by the principle set forth hereinabove of a chassis supporting the working members in relative movement with respect to the main chassis of the machine, and the comfort of the driving personnel who are in the cabs fast with the main chassis.

The accelerations and decelerations of the mobile chassis supporting the working members which appear at each work cycle are translated, taking into account the appreciable weight of this mobile chassis, by longitudinal inertia reactions, with repercussions on the main chassis of the tamping machine and considerably shaking the drivers in the cabs at the beginning and end of the phase of displacement. The resulting discomfort is all the greater as it is desired to increase the output of the tamping machine further by increasing the speed of displacement of the auxiliary chassis. Another effect of these reactions of inertia is manifested in a loss of adherence of the main chassis rolling on the rails at the moment when they appear. In practice, this requires giving the main chassis as high as possible an adherent driving load and therefore leads to higher costs in driving the machine.

It is an object of the present invention to provide a continuously advancing machine of the type described hereinabove, for which the reactions of inertia generated by the discontinuous displacements of the working members are eliminated, so that the increase in operating performances is no longer limited by an increasing discomfort of the driving personnel.

The invention resides in the fact that said means for driving the auxiliary chassis consist in a device for coupling the latter to a mobile carriage adapted to circulate on the track and provided with means for advance and means for immobilization with respect thereto, this coupling device making it possible to control variations in distance between the auxiliary chassis and the carriage.

In this way, the displacements of the auxiliary chassis and the working members that it bears may be ensured by immobilizing the carriage on the track and by varying the distance from the auxiliary chassis to said carriage by control of the coupling device which connects them. The result of this arrangement is that the reactions of inertia of the assembly of the auxiliary chassis and the working members are transmitted not to the chassis of the machine, but entirely to the track, via said carriage immobilized thereon, which causes any sensation of discomfort for the driving staff in the cabs to disappear. The output of the machine may consequently be increased by reduction of the step-by-step advance time of the auxiliary chassis and its working members.

The means for advancing the carriage, necessary to displace the latter between the consecutive displacements of the auxiliary chassis, may also be constituted by the coupling device mentioned above, operating in the direction opposite the direction which corresponds to the displacements of the auxiliary chassis.

The coupling device is preferably constituted by a rigid connecting assembly of which the length may vary under the control of a motor. Such a rigid connecting assembly is capable of transmitting both efforts of traction and of thrust, corresponding respectively to a decrease and to an increase in the distance between the carriage and the auxiliary chassis, the latter advantageously being provided with means for immobilization with respect to the track, which are actuated during phases of advance of the carriage. The coupling device thus constitutes a common drive means for driving the auxiliary chassis and the carriage in translation.

In a preferred embodiment, the rigid connecting assembly comprises an element of fixed length in series with an element of variable length. More precisely, this element of fixed length may be constituted by a bar articulated on the one hand on one of the two chassis to be connected (preferably the auxiliary chassis), on the other hand at a fastening point belonging to a mechanism borne by the other chassis (preferably that of the carriage) and capable, under the action of said motor, of displacing this point with respect to the latter chassis in the longitudinal direction of the track, in one direction or in the opposite direction. This mechanism may in particular be constituted by a chain extending horizontally, in the direction of the track, between two rotating gears mounted on the chassis bearing the mechanism, one of them being coupled to said motor.

The immobilization means with which the carriage and possibly the auxiliary chassis are equipped are advantageously constituted by at least one gripper mounted on board the respective chassis and capable, when so controlled, of firmly gripping a rail of the track, then of releasing it. The chassis of the carriage may for example be equipped with an assembly of two pairs of grippers cooperating with the two lines of rails of the track, and the auxiliary chassis of one pair of grippers also cooperating with the two lines of rails of the track.

The invention will be more readily understood on reading the following description with reference to the accompanying drawings, in which:

FIG. 1 schematically shows a machine according to the invention in side elevation.

Figure 3:
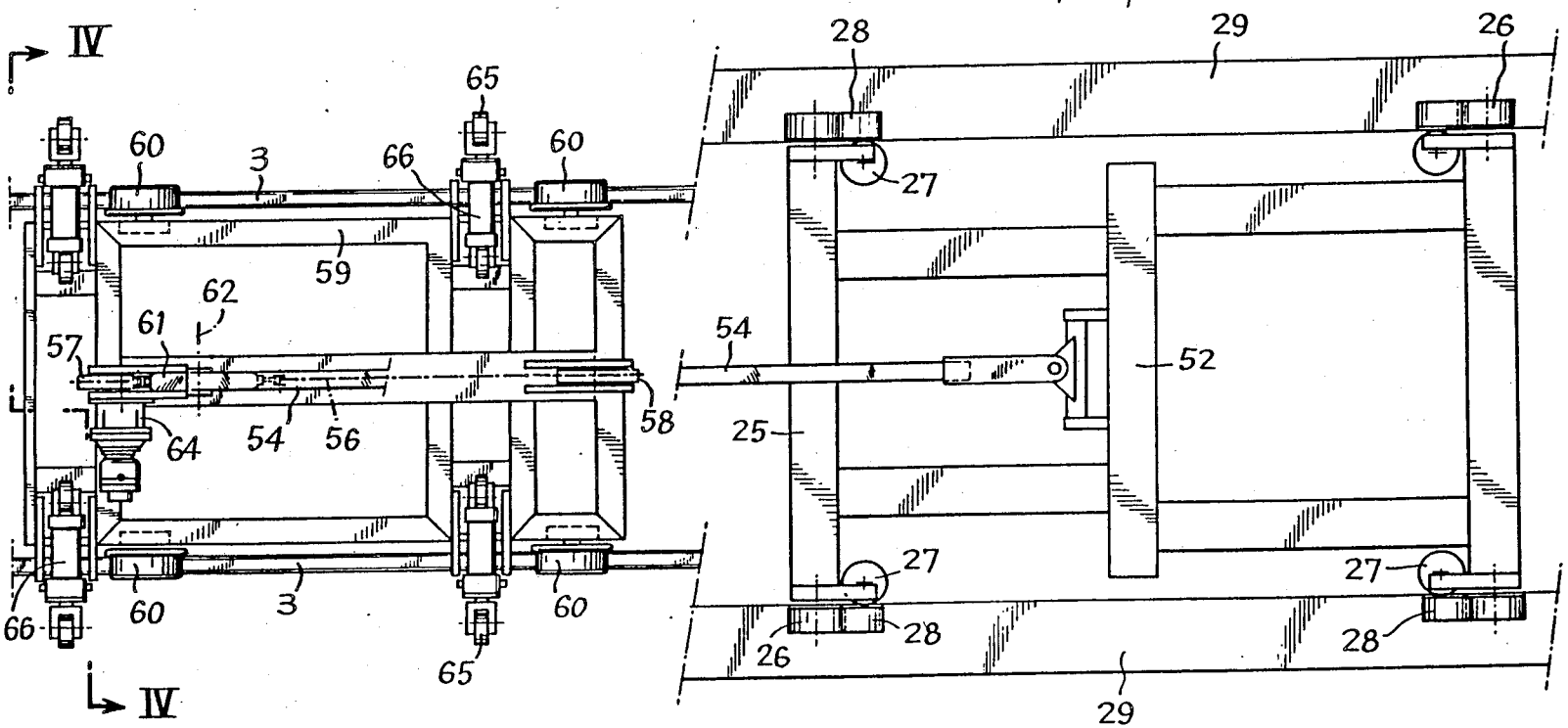
FIG. 3 shows a section along line III—III of the object of FIG. 2.
Figure 4:
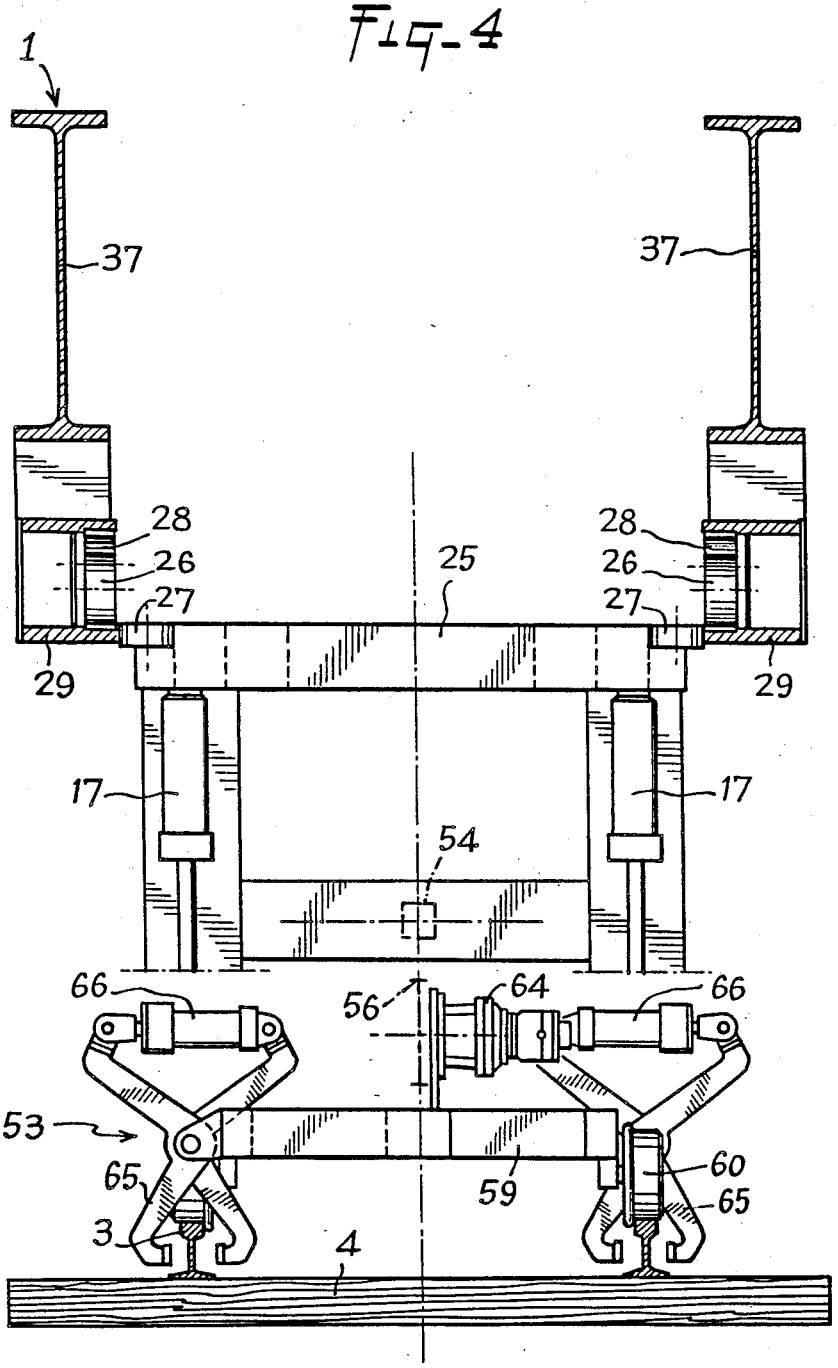
FIG. 4 shows a section along line IV—IV of the object of FIG. 3.

For greater clarity of the drawings, the working members have been omitted from FIGS. 3 and 4.

Figure 1:
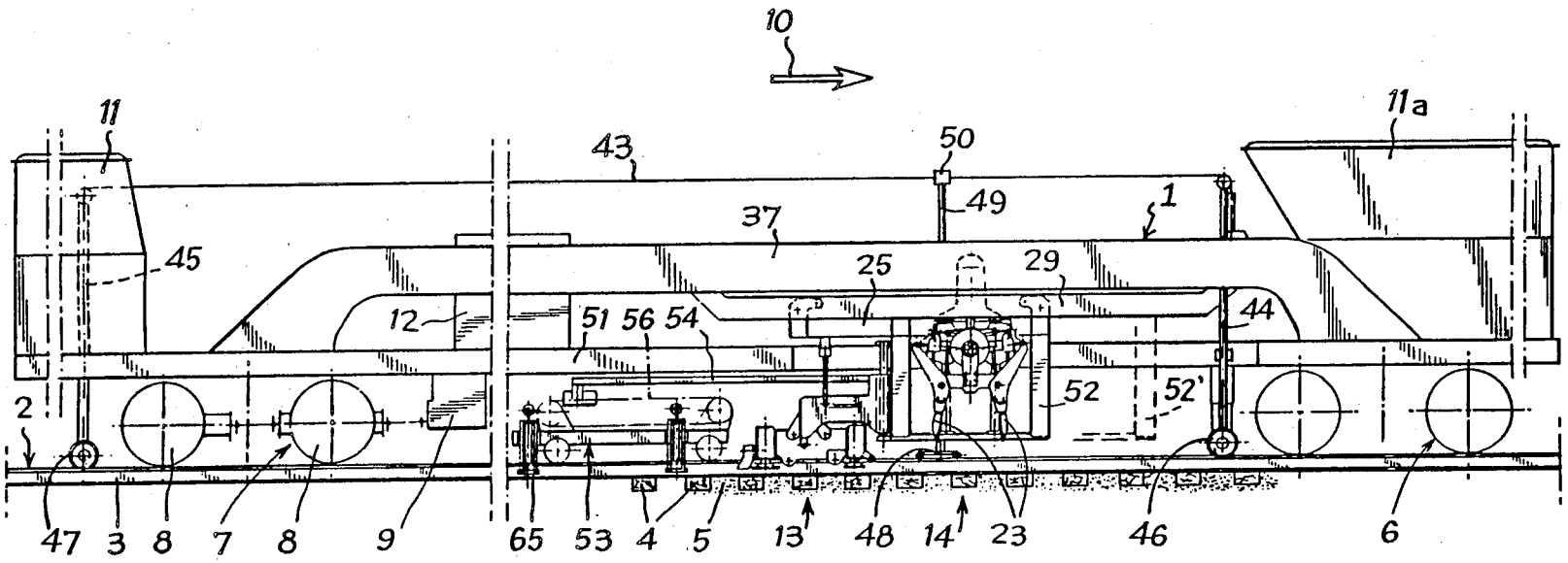
Figure 2:
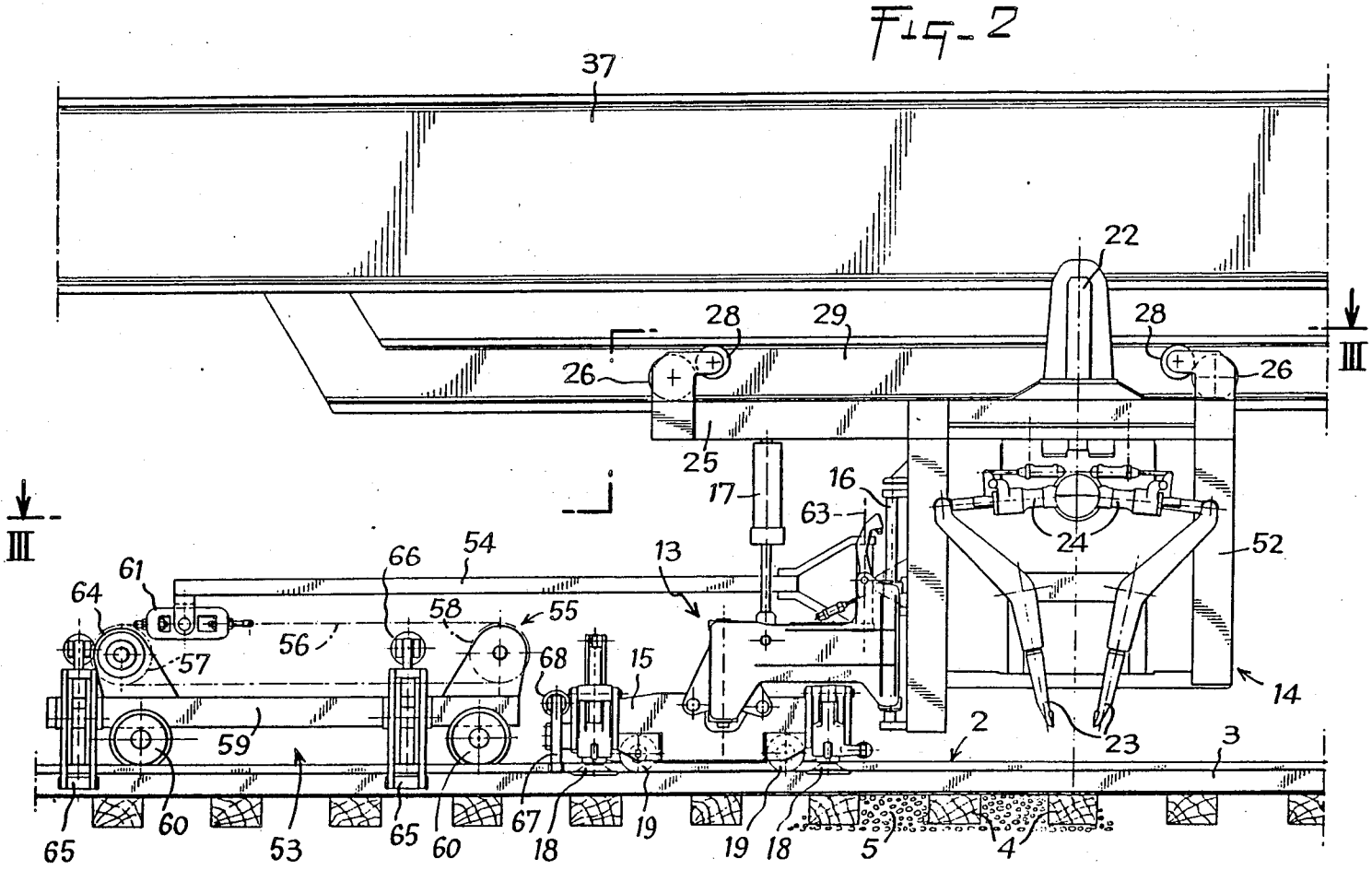
FIG. 2 shows, on a larger scale, that part of the object of FIG. 1 where the working members are located.

Referring now to the drawings, the machine shown in FIG. 1 comprises a main chassis 1 comprising a platform 51 and two strong sole bars 37, and resting on the track 2, constituted by rails 3 and ties 4 on a bed of ballast 5, via bogies 6, 7. The wheels 8 of bogie 7 are coupled to a drive motor 9 for advancing the machine in the direction indicated by arrow 10 during the work periods.

The machine further comprises two driver's cabs 11, 11*a* and an energy unit 12 supplying the motor 9 and the working members in particular.

The latter comprise a pair of lifting/shifting units 13 (one per line of rails 3) and a pair of tamping units 14 (likewise one per line of rails), which are borne by an auxiliary chassis 52.

Each lifting/shifting unit 13 comprises a chassis 15 adapted to slide vertically along a column 16, fast with the auxiliary chassis 52, under the action of a jack 17 to lift a line of rails gripped by two pairs of horizontal discs 18 borne by the chassis 15, and to pivot horizontally about this column under the action of another jack to shift the line of rails transversely via vertical discs 19 likewise borne by the chassis 15.

Each tamping unit 14, which may slide vertically along a column likewise fast with the auxiliary chassis 52, under the action of a jack 22, comprises a pair of vibratory tamping tools 23, actuated by jacks 24, which may penetrate in the ballast 5 on either side of a tie 4.

The auxiliary chassis 52 of the working members 13, 14 is fixed beneath a mobile chassis 25, adapted to move along the main chassis 1, where it is supported by four vertical rollers 26 and guided by four horizontal rollers 27. In addition, four other vertical rollers 28 take up the upwardly directed efforts which may be exerted on the mobile chassis 25. The rollers 26, 27, 28 cooperate with two side elements 29 belonging to the main chassis 1 and extending beneath the sole bars 37.

The auxiliary chassis 52 is coupled to a carriage 53, rolling on the track 2 by means of wheels 60, by a rigid connecting assembly of which it is possible to vary the length in order to move the auxiliary chassis 52 and the carriage 53 mutually towards or away from each other. This connecting assembly comprises a bar 54, of fixed length, and a device 55 for modifying the length of the connecting assembly. The device 55 is composed of a chain 56 stretched horizontally between two transmission gear wheels 57, 58 borne by the chassis 59 of the carriage 53. The chain 56 forms a closed loop, its ends being connected by a tensioning device 61 on which the bar 54 is articulated, along a horizontal axis 62, by one of its ends, its other end being articulated, along a vertical axis 63, on the auxiliary chassis 52. The gear 57 is coupled to a motor 64 for driving in rotation, which sets the chain in motion and thus causes the member 61 to move between gears 57, 58, in the longitudinal direction of the track 2, and thus vary the length of the assembly 54, 55 and therefore the distance separating the auxiliary chassis 52 and the carriage 53. Furthermore, the latter is provided with two pairs of grippers 65 which may be clamped on the rails 3, at the level of the web, under the action of hydraulic controls jacks 66 in order to immobilize the carriage 53 on the track. The auxiliary chassis 52 may similarly be immobilized by means of a pair of grippers 67 mounted on the chassis 15 of the lifting/shifting unit 13 and actuated by hydraulic jacks 68.

The operations of lifting/shifting of the track 2, intended to eliminate the defects in alignment that the track may present, are controlled by a leveling assembly with which the machine is equipped, which comprises a wire 43 stretched between the tops of two vertical rods 44, 45 widely spaced apart, resting on the track by small wheels 46, 47. Between the latter there is disposed a track sensing carriage 48 supporting a vertical rod 49 at the top of which is placed a displacement sensor 50 which, as a function of the position that it takes with respect to the wire 43, controls the level of the lifting/-shiftig units 13. Another similar assembly ensures lateral control relative to the corrections of layout of the track.

In operation, the machine is propelled continuously at low speed, in the direction of arrow 10, by the motor 9 which actuates the wheels of bogie 7. When an operation of lifting/shifting of the track 2 followed by an operation of tamping of the ballast 5 has terminated, the carriage 53, located behind the working units 13, 14 in the direction of advance of the machine, is immobilized by clamping the grippers 65 on the rails 3 under the action of jacks 66, while the grippers 67 which immobilized the auxiliary chassis 52 of the working units during these operations, are released. The motor 64 of the chain 56 is then started up and causes the latter to move, driving the member 61 from the rear gear 57 towards the front gear 58. This movement is communicated by the bar 54 to the auxiliary chassis 52 which advances by a quantity equal to double the pitch of the ties 4. When the new position 52' of the auxiliary chassis is reached, the motor 64 is cut off, the grippers 67 are clamped and grippers 65 are loosened, with the result that the chassis 52 is immobilized with a view to re-use of the working units, while carriage 53 is released. The motor 64 is then started up again, but in the opposite direction, and the corresponding movement of the chain 56 then causes the carriage 53 to move on the track 2 in the direction of the auxiliary chassis 52 until it recovers its initial position with respect thereto.

The working units 13, 14 are therefore alternately advanced step by step on the track 2, by thrust of the assembly 54, 55 for connection to the immobilized carriage 53, then the released carriage 53, by traction of the same assembly 54, 55 while the chassis 52 is immobilized and the working units are in action. The efforts of inertia generated by the successive displacements of the working groups have no repercussions on the main chassis 1 of the machine, as the forces of reaction are totally taken up by the track 2, via the carriage 53. Consequently, the movements of the working units, even the most sudden ones which correspond to their rapid passage from one tie 4 to the following tie between two tamping operations, do not induce any detrimental shaking in the main chassis 1 and the whole of the machine.

As far as the carriage 53 is concerned, as it is much lighter, by construction, than the auxiliary chassis 52, the reactions of inertia generated during its displacements are negligible. Moreover, they are also entirely transmitted to the track, via the grippers 67 immobilizing the auxiliary chassis 52 with respect to the track.

What is claimed is:

1. Continuously advancing machine for works on a railway track, comprising a main chassis and an auxiliary chassis which supports working members such as ballast tamping and track lifting/shifting units, the auxiliary chassis being connected to a mobile carriage which may move in translation along the main chassis under the action of drive means so as to advance, during the works, step by step with respect to the track while the machine progresses continuously, wherein:

said drive means comprises a device for coupling the auxiliary chassis to the mobile carriage adapted to circulate on the track and is provided with means for advance and means for immobilization with respect to the track, this coupling device controlling variations in the distance between the auxiliary chassis and the mobile carriage.

2. The machine of claim 1, wherein the coupling device is constituted by a rigid connecting assembly whose length my vary under the control of said means to advance, said means including a motor.

3. The machine of claim 2, wherein the rigid connecting assembly comprises an element of fixed length in series with an element of variable length.

4. The machine of claim 3, wherein the element of fixed length is an articulated bar connected to one of the auxiliary chassis and the mobile carriage and connected to a fastening point belonging to a mechanism borne by the other of the auxiliary chassis and mobile carriage and capable, under the action of the motor, of moving this point with respect to the auxiliary chassis in the longitudinal direction of the track in one direction and in the opposite direction.

5. The machine of claim 4, wherein said carriage includes a chassis, and the mechanism is borne by the chassis of the carriage.

6. The machine of claim 4, wherein the mechanism is constituted by a chain extending horizontally, in the direction of the track, between two rotatable gears mounted on the other of the auxiliary chassis and mobile carriage which bears the mechanism, one of the gears being coupled to the motor.

7. The machine of claim 1, wherein the auxiliary chassis is provided with means for immobilization with respect to the track.

8. The machine of claim 1, wherein the immobilization means with which one of the mobile carriage and auxiliary chassis is equipped is constituted by at least one gripper mounted on board the respective one of the mobile carriage and auxiliary chassis and capable, when controlled to do so, of firmly gripping a rail of the track then of releasing it.

9. The machine of claim 8, wherein the immobilization means comprises an assembly of two pairs of grippers cooperating with the two lines of rails of the track.

10. The machine of claim 8, wherein the auxiliary chassis is also equipped with immobilization means including a pair of grippers cooperating with the two lines of rails of the track.

* * * * *